United States Patent [19]

Babinsky et al.

[11] 4,093,531

[45] June 6, 1978

[54] APPARATUS FOR CONCENTRATION AND PURIFICATION OF A CELL LIQUOR IN AN ELECTROLYTIC CELL

[75] Inventors: Andrew D. Babinsky, Chagrin Falls; Leo L. Benezra, Mentor, both of Ohio

[73] Assignee: Diamond Shamrock Corporation, Cleveland, Ohio

[21] Appl. No.: 788,250

[22] Filed: Apr. 18, 1977

Related U.S. Application Data

[62] Division of Ser. No. 644,977, Dec. 29, 1975, Pat. No. 4,036,717.

[51] Int. Cl.[2] ..... C25B 9/00; C25B 13/08; C25B 5/00

[52] U.S. Cl. ..... 204/265; 204/266; 204/296; 204/DIG. 4

[58] Field of Search ..... 204/265, 296, DIG. 4, 204/266

[56] References Cited

U.S. PATENT DOCUMENTS

| | | | |
|---|---|---|---|
| 3,017,338 | 1/1962 | Butler et al. | 204/98 |
| 3,124,520 | 3/1964 | Juda | 204/86 |
| 3,135,673 | 6/1964 | Tirrell et al. | 204/98 |
| 3,222,267 | 12/1965 | Tirrell et al. | 204/98 |
| 3,262,868 | 7/1966 | Juda | 204/98 |
| 3,519,488 | 7/1970 | Giner | 136/86 |
| 3,784,456 | 1/1974 | Otto | 204/153 |
| 3,899,403 | 8/1975 | Cook et al. | 204/98 |

*Primary Examiner*—R. L. Andrews
*Attorney, Agent, or Firm*—Bruce M. Winchell

[57] ABSTRACT

Disclosed is a method and apparatus for the concentration and purification of a cell liquor containing sodium or potassium hydroxide wherein the three compartment electrolytic cell has a porous catalytic anode, a porous asbestos diaphragm separating the anode compartment and a central compartment having a stratification network, a cation-exchange membrane separating the central compartment and a cathode compartment having cathode disposed therein such that an electrolyzing current may be passed between the anode and cathode. Hydrogen gas emanating from the cathode and anode compartments is fed into the porous catalytic anode to decrease the potential across the cell below the evolution potential for chlorine and coincidently reduce the power requirements of the cell, which is operated at elevated temperatures.

6 Claims, 2 Drawing Figures

APPARATUS FOR CONCENTRATION AND PURIFICATION OF A CELL LIQUOR IN AN ELECTROLYTIC CELL

This is a division, of application Ser. No. 644,977, filed Dec. 29, 1975, U.S. Pat. No. 4,036,717.

BACKGROUND OF THE INVENTION

The present invention relates generally to the use of an electrolytic cell to purify and concentrate a cell liquor to obtain a marketable alkali metal hydroxide and recover the alkali metal salt for reuse in an electrolytic cell for electrochemical production. More particularly, the present disclosure relates to an improved method and apparatus for purification and concentration of a spent diaphragm cell liquor to remove sodium chloride, chlorates, metal impurities of various ionic character, and asbestos fibers from the cell liquor in a one step process at a savings of costs to obtain the marketable sodium hydroxide commodity. This employs the use of a three compartment cell having a porous catalytic anode, a porous asbestos diaphragm separating the anode compartment from a central compartment where the cell liquor is added, a cation-exchange membrane separating the central compartment and the cathode compartment and feeding of hydrogen gas emanating from the anode and cathode compartments into the porous catalytic anode to decrease the potential across the cell below the evolution potential for chlorine gas and coincidently reduce the amount of electrical power necessary for the purification and concentration process.

Chlorine and caustic (sodium hydroxide) are essential and large volume commodities which are basic chemicals required in all industrial societies. They are produced almost entirely electrolytically from aqueous solutions of alkali metal chlorides, with a major proportion of such production coming from diaphragm type electrolytic cells. In the diaphragm cell process, brine (sodium chloride solution) is fed continuously to the anode compartment and flows through a diaphragm usually made of asbestos, backed by a cathode. To minimize back-migration of hydroxide ions, the flow rate is always maintained in excess of the conversion rate so that the resulting catholyte solution has unused alkali metal chloride present. The hydrogen ions are discharged from the solution at the cathode in the form of hydrogen gas. The catholyte solution, containing caustic soda (sodium hydroxide), unreacted sodium chloride and other impurities, must then be concentrated and purified to obtain a marketable alkali metal hydroxide commodity and an alkali metal chloride which can be reused in the chlorine and caustic electrolytic cell for further production of alkali metal hydroxide.

Heretofore purification and concentration of the cell liquor containing caustic and salt has been accomplished by water evaporation, salt removal, chlorate removal, and metal impurities removal. Currently this costs approximately twenty dollars per ton and is increasing with the ever rising power cost. Even after this type of purification, one impurity remains which may cause future concern, mainly low concentrations of asbestos fibers. Due to the dramatic rise in power costs in the recent past and the desire to reduce capital investment in this process, a more efficient one step system for purifying and concentrating the spent cell liquor is needed to supply the production needs of the future.

Therefore, much attention has been directed to the use of an electrolytic cell for such a purification and concentration process. This has become especially pronounced since the wide use of hydraulically impermeable ion-exchange membranes in electrolytic cells which allow only selective migration of small cations or anions, thus presenting a feasible process for obtaining a much higher purity final product. One such proposal has been the use of fuel cell electrodes in electrolytic cells to use combustible fuels like hydrogen to decrease the anode potential below the evolution potential for chlorine gas so that no current is used in chlorine gas production. To date such proposals have not met with much commercial success basically because the efficiencies desired have not been achieved to this point.

SUMMARY OF THE INVENTION

It is therefore an object of the present invention to provide an electrolytic cell and a method capable of purifying and concentrating a cell liquor at an increased efficiency.

Another object of the present invention to provide an improved electrolytic cell and emthod for use thereof to purify and concentrate a cell liquor capable of being used in a commercial process with a lower capital investment in the process.

These and other objects of the present invention, together with the advantages tehreof over existing and prior art forms which will become apparent to those skilled in the art from the detailed disclosure of the present invention as set forth hereinbelow, are accomplished by the improvements herein shown, described, and claimed.

It has been found that an electrolytic cell for the concentration and purification of a cell liquor can be made up of a three compartment container, an anode compartment containing a porous catalytic anode, a porous diaphragm separating the anode compartment and a central compartment, an essentially hydraulically impermeable cation-exchange membrane separating the central compartment and a cathode compartment, a cathode disposed within the cathode compartment, access ways for passing a cell liquor into the central compartment and taking off the concentrated and purified alkali metal hydroxide from the cathode compartment, means for passing hydrogen gas into the anode compartment and across the porous catalytic anode, a means for passing an electrolyzing current between the anode and cathode, means for recirculating hydrogen gas emanating from the cathode and anode compartments back into the anode compartment and across the porous catalytic anode, and means for stratifying the cell liquor within the entral compartment.

It has also been found that a method employing the subject electrolytic cell of the present invention for the concentrating and purifying of a cell liquor can be accomplished by: assembling a three compartment electrolytic cell having a porous catalytic anode, a porous diaphragm to divide the anode compartment from a central compartment, an essentially hydraulically impermeable cation-exchange membrane dividing the central compartment from a cathode compartment, a cathode, and sufficient openings into the compartments to introduce and remove materials therefrom; charging the cathode compartment of the electrolytic cell with a pure solution of alkali metal hydroxide; charging the central compartment with the cell liquor to be concentrated and purified and recirculation thereof; supplying a flow of hydrogen gas to the anode compartment side of the porous catalytic anode at a guage pressure; preheating the electrolytic cell and materials to be charged thereto to a temperature above 60° C.; applying a direct electrolyzing current across the anode and cathode of the electrolytic cell; recycling hydrogen gas emanating from the anode and cathode compartments to the anode compartment and across the porous catalytic anode; removing concentrated and pure alkali metal hydroxide from the cathode compartment; and removing impurities and alkali metal salts from the central compartment.

One preferred embodiment of the subject improved method and apparatus for concentration and purification of a cell liquor in an electrolytic cell is shown by way of example in the accompanying drawings without attempting to show all the various forms and modifications in which the invention might be embodied; the invention being measured by the appended claims and not by the details of this specification.

DESCRIPTION OF THE PREFERRED EMBODIMENT

Figure 1:
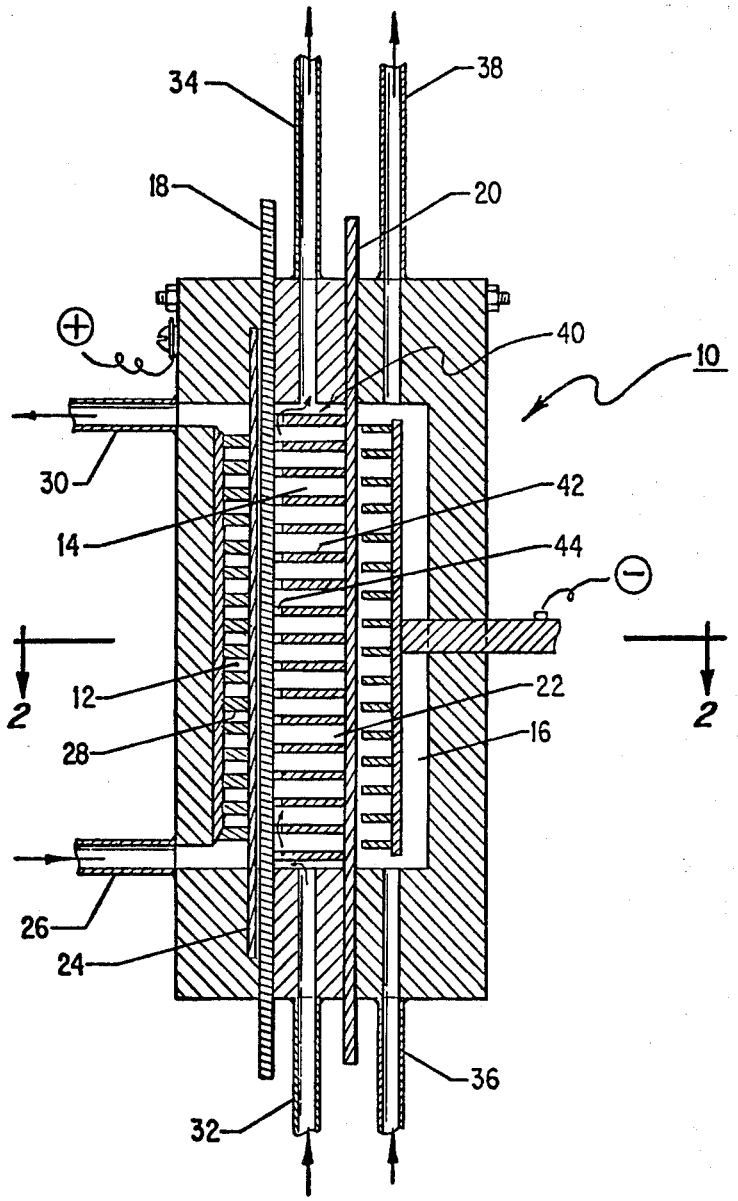
FIG. 1 is a side section view of an electrolytic cell taken on the vertical plane according to the concepts of the present invention which can be used for the purification and concentration of a cell liquor according to the method concepts of the present invention.

Referring to the drawing numeral 10 generally refers to an electrolytic cell having three compartments, numeral 12 referring to an anode compartment, numeral 14 referring to a central compartment and numeral 16 referring to a cathode compartment. Dividing the anode compartment 12 from the central compartment 14 is a porous diaphragm 18. Dividing the central compartment from the cathode compartment 16 is a membrane 20.

The porous diaphragm 18 may be made of any material compatible with the cell liquor environment, the proper bubble pressure, and electrical conductivity characteristics. If a porous anode with built-in diaphragm characteristics is used, then a separate diaphragm will not be required. In the particular case of the present invention, the porous diaphragm 18 must permit hydrogen ion flow from the anode compartment 12 to the central compartment 14 while simultaneously allowing reverse migration of hydroxyl ions and associated water molecules into the anode compartment 12 to form water with hydrogen ions in the anode compartment 12. One example of such a material is asbestos. A caustic resistant filter paper can also be used since it has a relatively low electrical resistance.

The membrane 20 separating the central compartment 14 and the cathode compartment 16 may be of any hydraulic impermeable cation-exchange membrane which is chemically resistant to cell liquor and hydroxides, has low resistivity, resists forward migration of chloride ions, and resists back migration of hydroxyl ions. This type of membrane 20 must be small cation permeable only so that sodium and potassium ions will migrate therethrough but virtually none of the larger metal cations such as the metal impurities of the cell liquor will pass therethrough. The use of these membrane materials will result in an alkali metal hydroxide of sufficient purity to meet normal commercial standards.

One type of hydraulically impermeable cation-exchange membrane which can be used in the apparatus of the present invention is a thin film of fluorinated copolymer having pendant sulfonic acid groups. The flourinated copolymer is derived from monomers of the formula $$FO_2SR_nCF = CF_2 \quad (1)$$

in which the pendant $-SO_2F$ groups are converted to $-SO_3H$ groups, and monomers of the formula $$CXX^1 = CF_2 \quad (2)$$

wherein R represents the group $$-\underset{}{\overset{R^1}{\overset{|}{C}}}F-CF_2-O-(CFY-CF_2O)_m$$

in which the $R_1$ is fluorine or fluoroalkyl of 1 thru 10 atoms; Y is fluorine or trifluoromethyl; $m$ is 1, 2 or 3; $n$ is 0 or 1; x is fluorine, chlorine or trifluoromethyl; and $x^1$ is $x$ or $CF_3CF_2)_a$, wherein $a$ is 0 or an integer from 1 to 5.

This results in copolymers used in the membrane for the cell having the repeating structural units $$-\underset{(R)_n}{\overset{F}{\overset{|}{C}}}-CF_2- \quad (3)$$
$$|$$
$$SO_3H$$

and $$-CXX^1-CF_2- \quad (4)$$

In the copolymer there should be sufficient repeating units according to formula (3) above, to provide an $-SO_3H$ equivalent weight of about 1000 to 1400. Membranes having a water absorption of about 25% or greater are preferred since higher cell voltages at any given current density are required for membranes having less water absorption. Similarly, membranes having a film thickness (unlaminated) of about 8 mils or more, require higher cell voltages in the process of the present invention and thus have a lower power efficiency.

Typically, because of large surface areas of the membranes present in commercial cells, the membrane film will be laminated to and impregnated into a hydraulically permeable, electrically non-conductive, inert, reinforcing member, such as a woven or non-woven fabric made of fibers of asbestos, glass, TEFLON, or the like. In film/fabric composite membranes, it is preferred that the laminating produce an unbroken surface of the film resin on at least one side of the fabric to prevent leakage through the membrane.

The hydraulically impermeable cation-exchange membranes of the type in question are further described in the following patents which are hereby incorporated by reference: U.S. Pat. Nos. 3,041,317; 3,282,875; 3,624,053; British Pat. No. 1,184,321 and Dutch Published Application No. 72/12249. Membranes as aforedescribed are available from E. I. duPont de Nemours and Co. under the trademark NAFION.

The membranes as above described can be further modified with surface treatments to obtain an improved membrane. Generally, these treatments consist of reacting the sulfonyl fluoride pendant groups with substances which will yield less polar bonding and thereby absorb fewer water molecules by hydrogen bonding. This has a tendency to narrow the pore openings through which the cations travel so that less water of hydration is transmitted with the cations through the membrane. An example of this would be to react an ethylene diamine with the pendant groups to tie two of the pendant groups together by two nitrogen atoms in the ethylene diamine. Generally, in a film thickness of about 7 mils, the surface treatment will be done to a depth of about 2 mils on one side of the film by means of a timed reaction procedure. This will result in a membrane with good electrical conductivity and cation transmission with less hydroxyl ion and associated water reverse migration.

Disposed within the cathode compartment 16 of the electrolytic cell 10 is a cathode 22 which may be constructed of any conventional electrolytically conductive material resistant to the hydroxide catholyte such as iron, mild steel, stainless steel, titanium, or nickel. Such a cathode 22 material should have a low hydrogen over-potential. The cathode 22 will generally be adjusted so as to provide a narrow gap between the plate thereof and the membrane 20 dividing the cathode compartment 16 and the central compartment 14. The cathode 22 will be connected to the negative terminal of a power source not shown.

Appropriately disposed within the anode compartment 12 of the electrolytic cell 10 is a porous catalytic anode 24. The porous catalytic anode 24 may be a fuel cell electrode, preferably a hydrogen fuel electrode, compatible with the cell liquor. Significant energy savings can be accomplished with a fuel electrode such as porous catalytic anode 24 by reason of the more efficient use of the current supply to the anode 24. The insertion of a fluid such as hydrogen eliminates the need of supplying sufficient energy to discharge a gaseous product at the anode 24 and is particularly helpful since the electrolytic cell 10 generates hydrogen gas at the cathode 22 anyway. The porous catalytic anode 24 is connected electrically to the positive terminal of an electrical supply source not shown to complete an electrical circuit by which an electrolyzing current may be passed through the electrolytic cell 10. Hydrogen gas is inserted through hydrogen supply line 26 into the anode compartment 12 where a meshlike grid work 28 allows the hydrogen gas to be distributed evenly across the entire surface of the porous catalytic anode 24. The hydrogen gas due to the electric current flowing through the cell is ionized into hydrogen ions which then pass through the porous diaphragm 18 into the central compartment 14. The meshlike grid work 28 also forms a support for the porous catalytic anode 24 to maintain it in a more or less planar spaced relation to the porous diaphragm 18. Excess hydrogen gas is removed through an escape port 30 in the anode compartment 12, and recirculated to supply line 26.

The central compartment has a cell liquor ingress 32 by which the cell liquor to be purified and concentrated is inserted into the central compartment of the electrolytic cell 10 and also at the top thereof is an egress 34 by which impurities and salt solutions may be taken from the electrolytic cell 10 for reuse in a chlorine and caustic cell.

The cathode compartment 16 may have an initial charge opening 36 by which a pure solution of alkali metal hydroxide is added to the cathode compartment prior to operation of the electrolytic cell 10. Also the cathode compartment 16 has an egress 38 by which purified and concentrated alkali metal hydroxide is removed from the electrolytic cell 10 upon completion of the electrochemical process described herein. The membrane 20 permits only small cations from the central compartment 14 to migrate into the cathode compartment 16 in significant quantities and will not permit anions or large cations such as the metal impurities to migrate from the cathode compartment 16 to the central compartment 14 in significant quantities due to the characteristic of the membrane hereinabove described. Also removed from the cathode compartment 16 at egress 38 will be hydrogen gas which can then be recirculated back into the hydrogen supply line 26 along with any hydrogen escaping from the escape port 30 in the anode compartment 12. Generally, additional amounts of hydrogen gas must be added to provide sufficient amounts of hydrogen gas for proper operation of the porous catalytic anode 24. This serves to make the most efficient use of by-product hydrogen and excess hydrogen escaping through the anode compartment to lower the electrical potential across the electrolytic cell 10 for the purification and concentration of a cell liquor.

Figure 2:
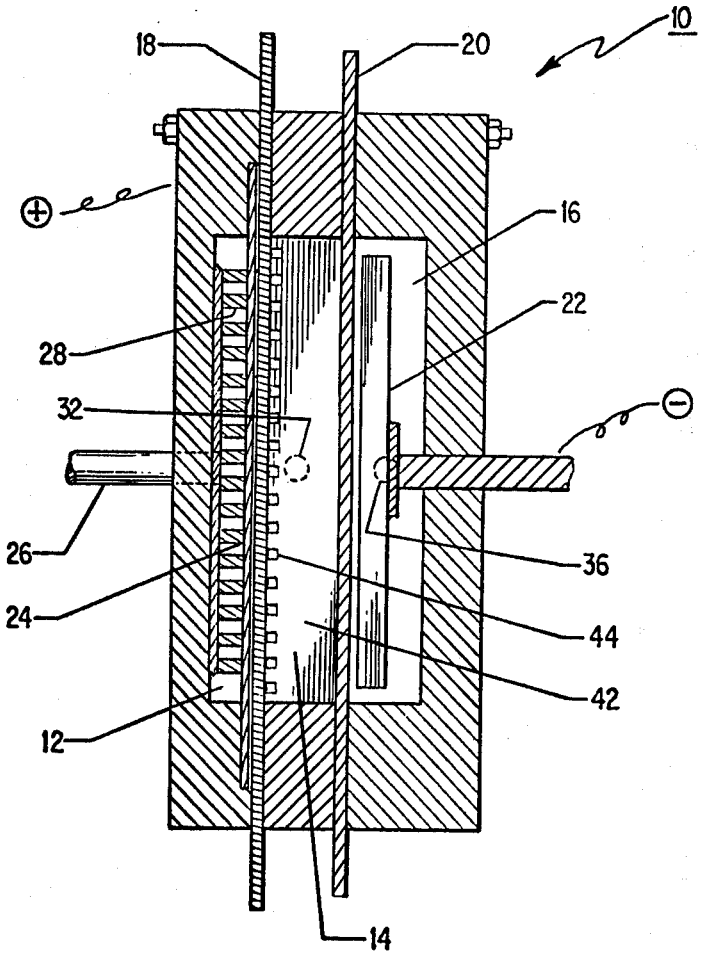
FIG. 2 is a side section view taken on the horizontal plane and substantially along line 2—2 of FIG. 1.

The central compartment 14 also has within its confines a stratification network 40. This stratification network 40 consists of a series of flat bars 42 in spaced horizontal relation to each other, connected to each end thereof to the sides of the central compartment 14, forming an effective seal therebetween. The flat bars 42 are up tight against the membrane 20 on the one side and extend all the way over to the other side of the central compartment 14 to touch the diaphragm 18. Along the edges touching the porous diaphragm 18 of these flat bars 42 are notches 44 to permit liquid flow from the bottom of the central compartment 14 cell liquor ingress 32, to the top of the central compartment 14 where the egress 34 is used to take off impurities and salt solution which then may be reused in a typical chlorine and caustic cell. These notches 44 thereby create a plurality of channels through the flat bars 42 as best seen in FIG. 2. As the cell liquor enters from cell liquor ingress 32, it will be stratified within the central compartment 14 and forced to flow in close proximity of the porous diaphragm 18 such that hydrogen ions emanating from the porous catalytic anode 24 will have ample opportunity to breakdown the cell liquor and create the cations which will then be transmitted across the membrane 20 into the cathode compartment 16. This assures an essentially turbid flow within each stratification section of the central compartment 14 but approaches laminar flow for the central compartment 14 taken as a whole, which greatly facilitates the electrochemical process by which the cell liquor is concentrated and purified. In this fashion the cell liquor will be essentially depleted of alkali metal cations by the time it reaches egress 34.

In a typical operation of electrolytic cell 10 for the purification and concentration of a cell liquor such as that from a chlorine and caustic production system, comprising mainly sodium hyrdoxide or potassium hydroxide, a three compartment cell is assembled, having an anode compartment with an anode therein, a central compartment, and a cathode compartment with a cathode therein. The electrolytic cell 10 must be effectively sealed with compressive force or gasketing. If bolts are used, they must be insulated to prevent short circuiting of the electrlytic cell 10. The porous catalytic anode 24 could be a platinum oxide gauze supported by a titanium screen such that hydrogen may be supplied to the hydrogen supply line 26 and present flow through the anode compartment 12 to the escape port 30. A porous diaphragm 18 is used to divide the anode compartment 12 from the central compartment 14 and can be made of an asbestos type material. A hydraulically impermeable cation-exchange membrane 20 is used to divide the central compartment 14 from the cathode compartment 16 and preferably would have a sulfonic acid pendant group equivalent weight in the range of 1000 to 1400. The cathode compartment 16 is initailly charged through the charge opening 36 with a solution of pure alkali metal hydroxide. The particular concentration of this initial charge does not seem to be of great significance to the overall operation with the exception that it will take a longer period of time to bring a lower concentration of this initial charge up to the resultant concentration. Generally, as a matter of convenience, this solution will be approximately 30 to 45 percent sodium hydroxide or potassium hydroxide as the case may be. The central compartment 14 is charged with the cell liquor to be purified and concentrated such as a spent cell liquor from a chlorine and caustic electrolytic cell through cell liquor ingress opening 32. As electrolyzing current is impressed upon the electrolytic cell 10 such that the anode potential will be maintained below the chlorine gas evolution potential. The cell operation temperatures can range from 75° to 100 ° C with a preferred range of 80° to 95° C. Hydrogen gas is inserted into the hydrogen supply at the gauge pressure required to maintain the hydrogen-electrolyte interface in the catalytic region of the porous catalytic anode 24, and any necessary pumps and circulation equipment shall be hooked up to egress 38 and escape port 30 to recirculate the hydrogen escaping from either of those two ports back into the hydrogen supply 26 maintaining this pressure at all times. The cell liquor solution in the central compartment 14 is recirculated at a rate sufficient to allow essentially complete depletion of alkali metal cations by the time the solution reaches egress 34. Generally the spent cell liquor inserted into the central compartment 14 will have a sodium hydroxide concentration of approximately 11 percent and a sodium chloride concentration of approximately 14 percent. The solution exiting from egress 34 of the central compartment 14 will generally have a sodium hydroxide concentration of approximately 6 percent and a sodium chloride concentration of approximately 18 percent plus whatever impurities may be present in cell liquor which are being separated from the alkali metal hydroxide. With careful control sodium hydroxide concentrations as low as 0.5 percent can be achieved. The purified and concentrated alkali metal hydroxide exiting from the egress 38 of the cathode compartment 16 will generally have a resultant sodium hydroxide concentration of 30 to 40 percent and a resultant sodium chloride concentration of approximately 0.1 through 0.5 percent. The current efficiencies found for electrolytic cells operated in this manner run from a low of approximately 60 percent to a high of approximately 80 percent.

Thus it should be apparent from the foregoing description of the preferred embodiment that the device herein shown and described accomplishes the objects of the invention and solves the problems attendant to such devices as heretofore described.

What is claimed is:

1. An electrolytic cell for the concentration and purification of a cell liquor comprising: a three compartment container; a porous catalytic anode disposed within an anode compartment of said container; a porous diaphragm separating the anode compartment and a central compartment; an essentially hydraulically impermeable cation-exchange membrane separating the central compartment and a cathode compartment; a cathode disposed within the cathode compartment; means for passing a cell liquor into the central compartment; means for passing hydrogen gas into the anode compartment and across said porous catalytic anode; means for passing an electrolyzing current between said anode and said cathode; means for recovering the purified and concentrated alkali metal hydroxide from the cathode compartment; means for recirculating hydrogen gas emanating from the cathode compartment and the anode compartment back into the anode compartment and across said porous catalytic anode; and means for stratifying the cell liquor within the central compartment.

2. An electrolytic cell according to claim 1 further comprising a means for circulating said cell liquor within the central compartment at a rate high enough to insure essentially complete depletion of alkali metal cations from the cell liquor by the time one cycle through the central compartment is completed.

3. An electrolytic cell according to claim 1 wherein said means for stratifying the cell liquor within the central compartment comprises a plurality of flat bars connected to the side walls of the central compartment having a plurality of notches in each of said flat bars so as to form a plurality of channels adjacent said porous diaphragm to force the cell liquor flow theralong and to rectify the cell liquor in stages equivalent to the number of said flat bars.

4. An electrolytic cell according to claim 1 wherein said membrane is a hydraulically impermeable cation-exchange membrane consisting essentially of a film of copolymer having the repeating structural units of the formula:

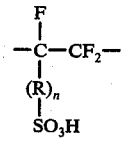

(I)

and (II) $-CXX^1-CF_2-$ wherein R represents the group

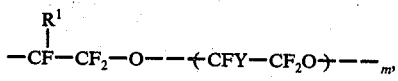

in which $R^1$ is fluorine or perfluoroalkyl of 1 to 10 carbon atoms; Y is fluorine or trifluoromethyl; *m* is 1, 2 or 3; *n* is 0 or 1; *x* if fluorine, chlorine, or trifluoromethyl; $X^1$ is *x* or $CF_2-CF_2\rangle_a$; *a* is 0 or integer from 1 to 5; and the units of the formula I being present in an amount to provide a copolymer having a $-SO_3H$ equivalent weight in the range of 1,000 to 1,400.

5. An electrolytic cell according to claim 4 wherein said means for passing hydrogen maintains the hydrogen-electrolyte interface in the catalytic region of said porous catalytic anode.

6. An electrolytic cell according to claim 1 wherein said copolymer has a $-SO_3H$ equivalent weight within the preferred range of 1,100 to 1,200.

* * * * *